US008907996B2

(12) United States Patent
Kyoi

(10) Patent No.: US 8,907,996 B2
(45) Date of Patent: Dec. 9, 2014

(54) THERMAL HEAD AND THERMAL TRANSFER PRINTER USING THERMAL HEAD

(75) Inventor: Toshiaki Kyoi, Tokyo (JP)

(73) Assignee: Sato Holdings Kabushiki Kaisha (JP)

( * ) Notice: Subject to any disclaimer, the term of this patent is extended or adjusted under 35 U.S.C. 154(b) by 0 days.

(21) Appl. No.: 13/992,157

(22) PCT Filed: Jul. 19, 2011

(86) PCT No.: PCT/JP2011/004072

§ 371 (c)(1),
(2), (4) Date: Jun. 6, 2013

(87) PCT Pub. No.: WO2012/077255

PCT Pub. Date: Jun. 14, 2012

(65) Prior Publication Data

US 2013/0250027 A1 Sep. 26, 2013

(30) Foreign Application Priority Data

Dec. 10, 2010 (JP) ..... 2010-276075

(51) Int. Cl.

| | |
|---|---|
| ***B41J 2/335*** | (2006.01) |
| ***B41J 17/28*** | (2006.01) |
| ***B41J 2/32*** | (2006.01) |
| ***B41J 2/325*** | (2006.01) |
| ***B41J 35/08*** | (2006.01) |

(52) U.S. Cl.

CPC .. *B41J 2/32* (2013.01); *B41J 2/335* (2013.01); *B41J 2/325* (2013.01); *B41J 17/28* (2013.01); *B41J 35/08* (2013.01)

USPC ..... 347/200

(58) Field of Classification Search

USPC ..... 347/215, 216, 200

See application file for complete search history.

(56) References Cited

U.S. PATENT DOCUMENTS

2009/0309949 A1 * 12/2009 Fukutani et al. ..... 347/217

FOREIGN PATENT DOCUMENTS

| | | | | |
|---|---|---|---|---|
| JP | 2002-144614 | * | 5/2002 | ..... B41J 2/325 |
| JP | 2003-94705 | | 4/2003 | |
| JP | 2004-262018 | | 9/2004 | |
| JP | 2005-212130 | * | 8/2005 | ..... B41J 17/04 |
| JP | 2010-599 | | 1/2010 | |

OTHER PUBLICATIONS

Computer-generated translation of JP 2003-094705, published on Apr. 2003.*

Computer-generated translation of JP 2010-000599, published on Jan. 2010.*

Computer-generated translation of JP 2005-212130, published on Aug. 2005.*

International Search Report and Written Opinion dated Sep. 6, 2011 issued in corresponding International Patent Application No. PCT/JP2011/004072.

* cited by examiner

*Primary Examiner* — Huan Tran

(74) *Attorney, Agent, or Firm* — Ostrolenk Faber LLP

(57) ABSTRACT

A thermal head in a thermal transfer printer in which a tension is given to an ink ribbon that has warped as being heated by the thermal head to reduce friction force generated between the thermal head and the ink ribbon. A ribbon transport direction changing member 30 pushes the ink ribbon 13 away from a heat generator 21, as a transport direction of the ink ribbon 13 is slightly moved toward a platen roller 10, so a constant tension is given to a film layer 24 of the ink ribbon immediately after being heated.

10 Claims, 6 Drawing Sheets

PRIOR ART

THERMAL HEAD AND THERMAL TRANSFER PRINTER USING THERMAL HEAD

CROSS-REFERENCE TO RELATED APPLICATIONS

The present application is a 35 U.S.C. §§371 national phase conversion of PCT/JP2011/004072, filed Jul. 19, 2011, which claims priority of Japanese Patent Application No. 2010-276075, filed Dec. 10, 2010, the contents of which are incorporated by reference herein. The PCT International Application was published in the Japanese language.

TECHNICAL FIELD

The present invention relates to a thermal head and a thermal transfer printer in which the thermal head is used. In particular, the present invention can reduce friction force to be generated between the thermal head and an ink ribbon.

BACKGROUND

In a conventional thermal transfer printer, an ink ribbon and printing paper are sandwiched between a thermal head and a platen roller to melt ink on the ink ribbon with heat generated by the thermal head. Then, by transferring and fixing the molten ink onto the printing paper, the thermal transfer can print predetermined information on the printing paper.

An example of an existing thermal transfer printer will be described in detail with reference to FIGS. 4A-4B.

FIG. 4A is a schematic side view of a thermal transfer printer 1. The thermal transfer printer 1 includes a housing 2, a printing paper supply unit 3, a printing unit 4, and a printing paper cutting unit 5. A discharge port 6 is formed in the housing 2 downstream from the printing paper cutting unit 5.

The printing paper supply unit 3 has a supply shaft 7, and a rolled printing paper 8 is held by the supply shaft 7. The printing unit 4 includes a thermal head 9, a platen roller 10 that is located to oppose the thermal head 9, an ink ribbon supply unit 11, and an ink ribbon take-up unit 12. An ink ribbon 13 is guided from the ink ribbon supply unit 11 to the ink ribbon take-up unit 12 by guide rollers 14 to stretch along a lower portion of the thermal head 9.

The printing paper 8 that is supplied from the printing paper supply unit 3 is transported by a transport roller 15 toward the printing unit 4 located downstream from the printing paper supply unit 3. The transported printing paper 8 is sandwiched, together with the ink ribbon 13, between the thermal head 9 and the platen roller 10. At this point, ink on the ink ribbon 13 melts with heat generated in the thermal head 9, and predetermined information is printed on the printing paper 8. After printing, the printing paper 8 is cut by the printing paper cutting unit 5 in a desired length and discharged to the outside of the thermal transfer printer 1 through the discharge port 6.

FIG. 4B is an enlarged sectional view of a portion of the printing paper 8 enclosed by a circled dotted line 4B in FIG. 4A. As illustrated in FIG. 4B, the printing paper 8 includes a base material 16 that is coated with an adhesive 17. The base material 16 is temporarily affixed to a board 19 via a silicone layer 18 that serves as a release agent. As ink is transferred and fixed onto a surface of the base material 16, the predetermined information is displayed thereon.

Subsequently, the thermal head 9 to be used in the thermal transfer printer 1 will be described with reference to FIG. 5.

FIG. 5 is a rear view of the thermal head 9 as viewed from the side of the platen roller 10. A direction shown by an arrow in FIG. 5 indicates a transport direction of the printing paper 8 from an upstream side toward a downstream side.

The thermal head 9 includes a head body 20 that is configured of a heatsink, a heat generator 21, a connector unit 22 which transmits a signal to control an amount of heat in the heat generator 21 through a control unit in a body (printer body) of the thermal transfer printer 1, and an engaging unit 23 which supports the thermal head 9 onto an unillustrated bracket of the body.

The heat generator 21 includes a plurality of heating elements arrayed intermittently extending parallel in a widthwise direction of the thermal head 9. The heating elements emit heat to melt the ink on the ink ribbon 13. The predetermined information is printed as the molten ink is transferred and fixed onto the printing paper 8.

In the thermal transfer printer 1 configured as described above, circumstances that lead to printing failure have been observed. The circumstances include the ink ribbon 13 sagging, being wrinkled, or traveling obliquely. As a method of retaining constant tension of the ink ribbon 13 in order to prevent wrinkles or the like from being generated in the ink ribbon 13, a method exists in which a speed at which the ink ribbon 13 is taken up is controlled in an unillustrated control unit such that the speed at which the ink ribbon 13 is taken up exceeds a speed at which printing paper is transported, or a method in which a guide member is provided to guide the ink ribbon 13 at a position where the ink ribbon 13 is separated from the printing paper 8 in the thermal head 9 and redirected toward the ink ribbon take-up unit 12 (see, for example, PTL 1).

However, in the thermal transfer printer 1 having the above-described configuration, when, for example, black and white are reversed in printing or printing density is increased, thermal energy is concentrated at a part of the ink ribbon 13. Then, a wave-like warp is generated partially in the ink ribbon 13 due to the heat. There is a possibility that wrinkles are generated due to the warp and uniform tension is not given to the ink ribbon 13, which results in printing failure or oblique traveling of the ink ribbon 13.

SUMMARY OF INVENTION

Technical Problem

A detailed description will be given using FIG. 6. FIG. 6 is an enlarged side view of the printing unit 4 in FIG. 4A.

The printing paper 8 is transported in accordance with a rotary drive (a direction illustrated by an arrow in FIG. 6) of the platen roller 10. After being heated by the heat generator 21, the ink ribbon 13 is redirected by a redirecting member 27 away from the platen roller 10 and taken up by the ink ribbon take-up unit 12 illustrated in FIG. 4A.

The ink ribbon 13 includes a film layer 24 and an ink layer 25 that is applied on the film layer 24. The thickness of the ink ribbon 13 is 6 μm to 8 μm. The ink in the ink layer 25 is heated with heat generated by the heat generator 21 that is located to the side of the film layer 24. The ink ribbon 13 is separated from the printing paper 8 after the ink is cooled to be transferred and fixed onto the printing paper 8. When printing in this way, the ink on the ink ribbon 13 is made molten by the thermal head 9 and remains in a molten state until the ink ribbon 13 is separated from the printing paper 8 at a downstream side of the thermal head.

The film layer 24 of the ink ribbon 13 immediately after being heated by the heat from the thermal head 9 warps in a wave-like shape if the amount of received heat is high. And, the ink in the ink layer 25 that is in a molten state deforms in accordance with a shape of the warped film layer 24. Therefore, simply adjusting the speed at which the ink ribbon 13 is taken up or only providing the guide member to guide the ink ribbon 13 toward the ink ribbon take-up unit 12 after the ink ribbon 13 and the printing paper 8 are separated from each other as described in PTL 1 does not allow uniform tension to be given to the ink ribbon 13 that has warped in a wave-like shape in a state where the ink is molten immediately after being heated by the thermal head 9.

Further, since printing is carried out in a state where the ink ribbon 13 and the printing paper 8 are pressed against the thermal head 9 by the platen roller 10, a constant friction force is continuously generated between the thermal head 9 and the ink ribbon 13. Then, the friction force is enhanced at a location where the ink ribbon 13 is warped due to the heat compared to a location where the ink ribbon 13 is not warped. Accordingly, the speed at which the ink ribbon 13 is taken up is reduced from a preset speed. On the other hand, since the printing paper 8 is transported by the platen roller 10, a difference in speed of the ink ribbon 13 and the printing paper 8 is increased from a preset difference. Then, the ink in a molten state is pulled toward the direction in which the printing paper 8 is transported, and the ink ribbon 13, on the contrary, is braked between the printing paper 8 and the thermal head 9 toward the direction opposite to the transport direction of the printing paper 8. Thus, there has been a possibility that the ink is separated within the ink layer 25 (refer to an intra-layer separation part 26). When an intra-layer separation occurs, a shade of printed information partially varies, and the information is prevented from being displayed appropriately.

As one of the methods to solve the above-described problem, a method in which the redirecting member 27 that is located downstream from the thermal head 9 is adjusted toward a direction intersecting with the ink ribbon 13 to adjust the ink ribbon 13 to be pressed toward a direction away from the thermal head 9 can be contemplated. However, this adjustment requires a highly skilled operation and could not easily be carried out by a typical user.

The present invention has been made in view of the above-described problem, and it is an object of the present invention to provide a thermal head and a thermal transfer printer in which tension is given to an ink ribbon that has warped as being heated by the thermal head to reduce friction force to be generated between the thermal head and the ink ribbon without requiring a highly skilled operation.

Solution To Problem

A first aspect of the present invention provides a thermal head that includes a head body; a heat generator including a plurality of heat generators aligned on the head body, wherein the thermal head allows a printing paper and an ink ribbon to be transported between the thermal head and a platen roller opposed to the thermal head and allows necessary and possible printing information to be transferred onto the printing paper using the ink ribbon; and a ribbon transport direction changing member which is provided to be parallel to the heat generator in a vicinity of the heat generator of the head body, wherein the ribbon transport direction changing member protrudes toward the platen roller than the heat generator.

Further, the ribbon transport direction changing member includes projections which are intermittently provided.

Further, the ribbon transport direction changing member is provided downstream side with respect to the heat generator.

Further, the projections are formed by intermittently applying a non-volatile resin to bulge portions to which the resins are applied.

Further, the projections are formed so that tips of the projections are circular-arc-shaped.

Further, a second aspect of the present invention provides a thermal transfer printer that includes a thermal head; and a platen roller which is arranged to oppose the thermal head, wherein the thermal transfer printer carries out a printing operation with printing paper and an ink ribbon which is capable of being transferred to print on the printing paper which are sandwiched between the thermal head and the platen roller, and wherein the thermal head includes a heat generator including a plurality of heating elements extending parallel and in a widthwise direction of the printing paper and includes a ribbon transport direction changing member in a vicinity of the heat generator, and a tip of the ribbon transport direction changing member protrudes toward the platen roller to a position to make contact with the ink ribbon.

Advantageous Effects of Invention

According to the first aspect of the present invention, by providing the ribbon transport direction changing member in the vicinity of the heat generator of the thermal head, a transport path of the ink ribbon can be moved toward the platen roller to give a tension to the ink ribbon. Thus, a friction force to be generated between the ink ribbon and the thermal head can be reduced, and a separation within the ink layer can be prevented with ease.

Further, according to the second aspect of the present invention, by using the thermal head which is provided with the ribbon transport direction changing member in the vicinity of the heat generator in the thermal transfer printer, a favorable printing quality can be obtained by reducing the friction force to be generated between the ink ribbon and the thermal head even when high thermal energy is concentrated on the ink ribbon as in a case where black and white are reversed in printing or the like.

DESCRIPTION OF EMBODIMENTS (Embodiments)

Figure 1A:
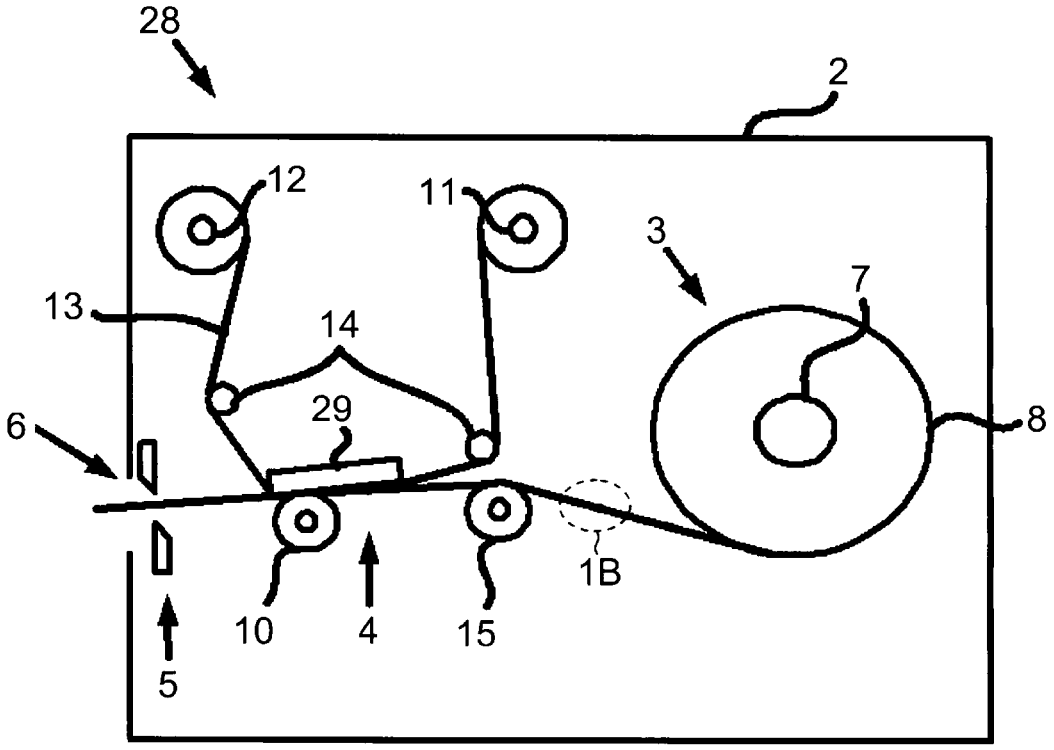
FIG. 1A is a schematic side view of a thermal transfer printer according to an embodiment of the present invention.
Figure 1B:
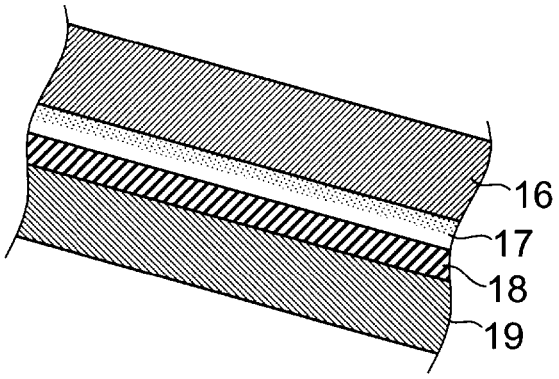
FIG. 1B is an enlarged sectional view of a portion of a printing paper enclosed by a circled dotted line 1B in FIG. 1A.

A thermal transfer printer 28 and a thermal head 29 according to an embodiment of the present invention will be described using FIGS. 1A to 3.

Here, configurations that are similar to those of the existing technique in FIGS. 4A to 6 are referenced by the same reference numerals and detailed descriptions thereof will be omitted.

FIG. 1A is a schematic side view of the thermal transfer printer 28. The printing paper supply unit 3 is provided at an uppermost-stream side of the thermal transfer printer 28. The printing paper 8 that is supplied from the printing paper supply unit 3 is sandwiched, together with the ink ribbon 13 that is supplied from the ink ribbon supply unit 11, between the thermal head 29 and the platen roller 10 in the printing unit 4 which is located downstream side from the printing paper supply unit 3, and a predetermined information is printed on the printing paper 8. Then, the printing paper 8 is cut in a desired size in the printing paper cutting unit 5 located further downstream and discharged through the discharge port 6.

Figure 2A:
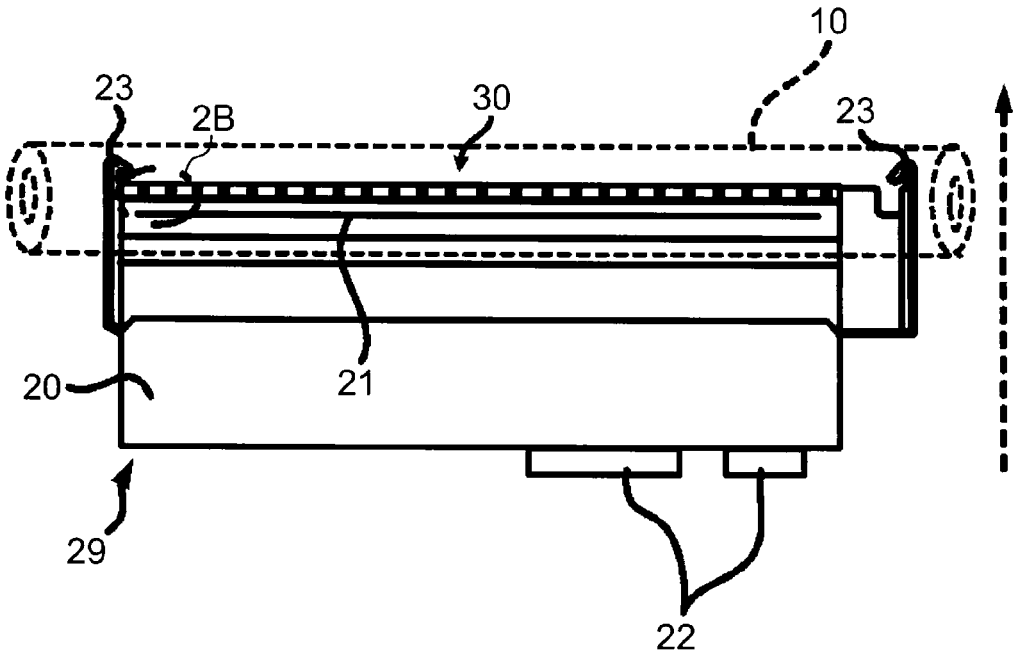
FIG. 2A is a rear view of a thermal head according to an embodiment of the present invention as viewed from a side of a platen roller.
Figure 2B:
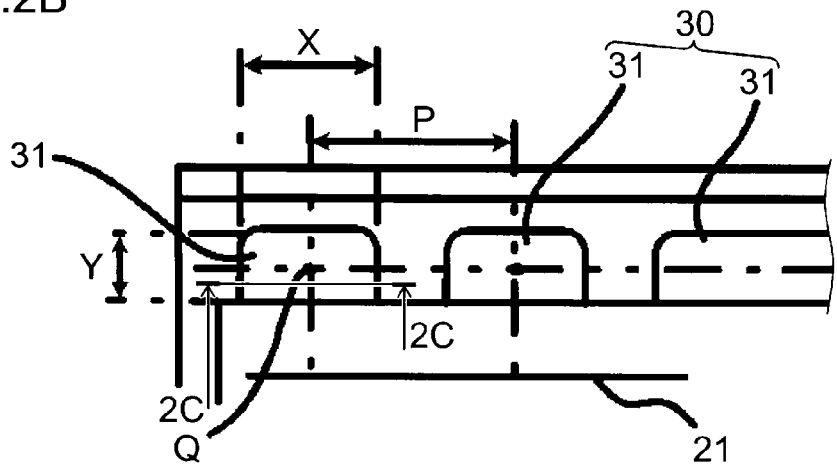
FIG. 2B is an enlarged view of a vicinity of a ribbon transport direction changing member enclosed by a circled dotted line 2B.
Figure 2C:
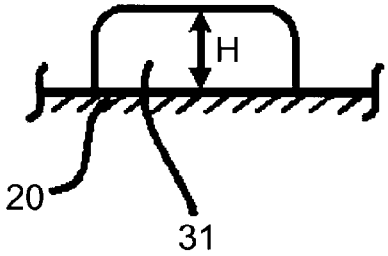
FIG. 2C is a sectional view of the ribbon transport direction changing member taken along a line 2C-2C in FIG. 2B.

FIG. 2A is a rear view of the thermal head 29 as viewed from a side of the platen roller 10. FIG. 2B is an enlarged view of a vicinity of a ribbon transport direction changing member enclosed by a circled dotted line 2B in FIG. 2A. The length of the member 30 across the printing paper is seen. FIG. 2C is a sectional view of the ribbon transport direction changing member 30 taken along a line 2C-2C in FIG. 2B. The length of the member 30 along the printing paper is seen.

The thermal head 29 includes the heat generator 21 that is arranged in a widthwise direction thereof, and the heat generator 21 includes heating elements intermittently aligned. Ink on the ink ribbon 13 is molten as the heating elements emit heat, and the predetermined information is printed as the molten ink is fixed onto the printing paper 8. The ribbon transport direction changing member 30 extends in a widthwise direction of the thermal head 29 and is downstream from the vicinity of the heat generator 21 in the direction of the printing paper. The vicinity referred to herein is, for example, in a range of 1.0 mm to 1.5 mm downstream from the heat generator 21.

The ribbon transport direction changing member 30 includes a plurality of projections 31, which serve as projecting members, provided intermittently in a widthwise direction of the thermal head 29, and downstream in the direction of the printing paper from the heat generator 21. The projection 31 has a length X in a widthwise direction of the thermal head 29 of 2.2 mm to 3.1 mm, and the length X can preferably be 3.0 mm. Further, the projection 31 has a length Y in a paper transport direction in the thermal head 29 of 1.0 mm to 1.2 mm, and the length Y can preferably be 1.0 mm. Further, the projection 31 protrudes toward a platen by a thickness H of 0.1 mm to 0.12 mm, and the thickness H can preferably be 0.1 mm. Furthermore, a pitch P between a center point Q of a projection 31 and a center point Q of an adjacent projection 31 is 7.0 mm to 9.0 mm, and the pitch P can preferably be 8.0 mm.

Further, the projections 31 can be formed by applying a non-volatile resin, and a shape of a tip of the projection 31 that comes in contact with the ink ribbon 13 can be formed into a circular arc.

A relationship between the ink ribbon 13 and the printing paper 8 in a case where predetermined information is printed on the printing paper 8 by the thermal transfer printer 28 that includes the thermal head 29 will be described based on FIG. 3.

Figure 3:
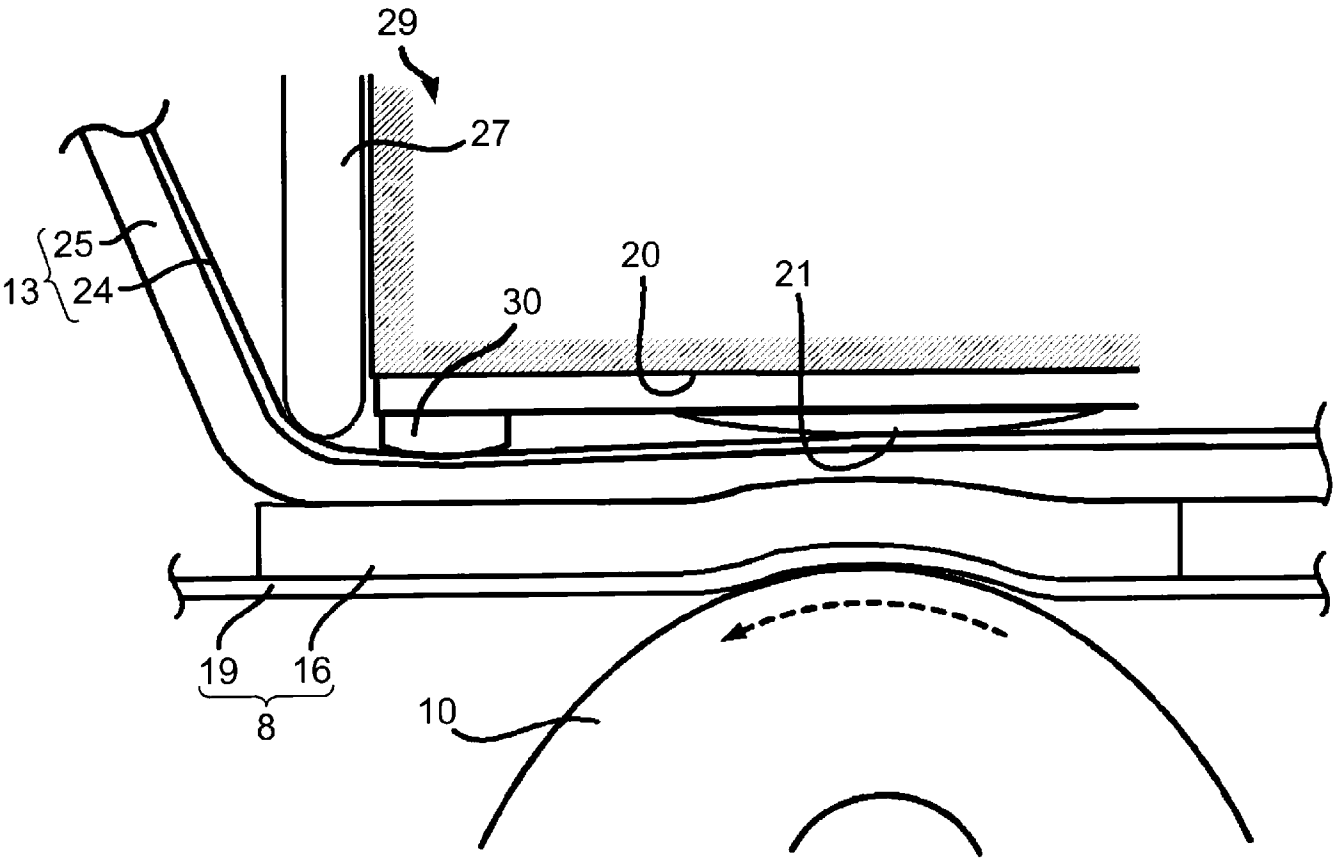
FIG. 3 is an enlarged sectional view of a printing unit of the thermal transfer printer in FIG. 1A, which includes the thermal head.
Figure 4A:
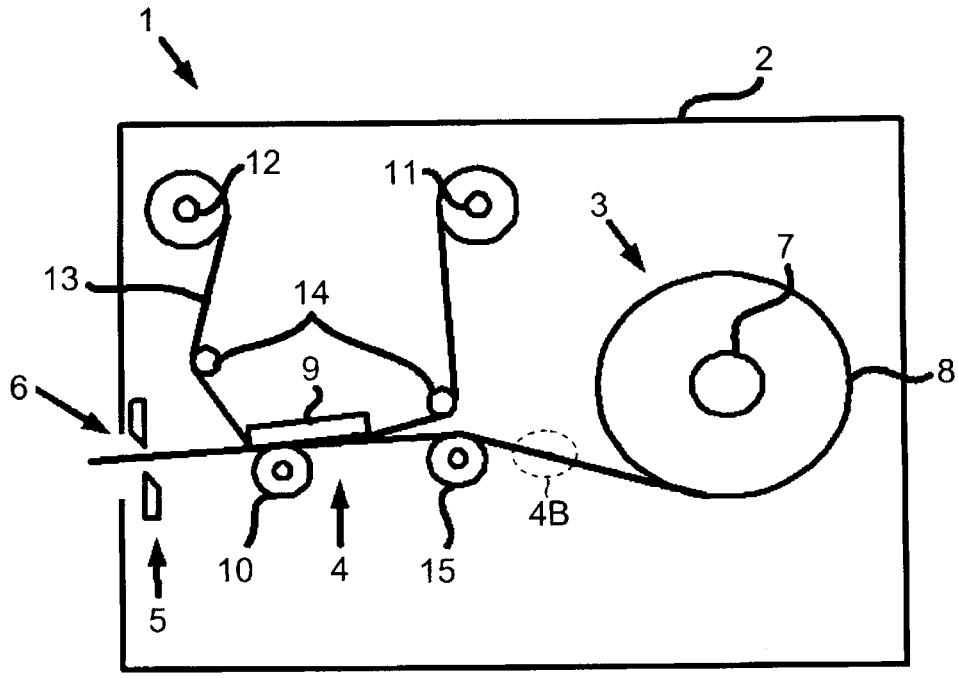
FIG. 4A is a schematic side view of an existing thermal transfer printer.
Figure 4B:
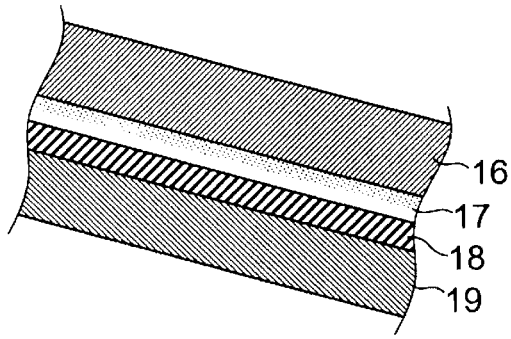
PRIOR ART FIG.4B
FIG. 4B is an enlarged sectional view of a portion of a printing paper enclosed by a circled dotted line 4B in FIG. 4A.
Figure 5:
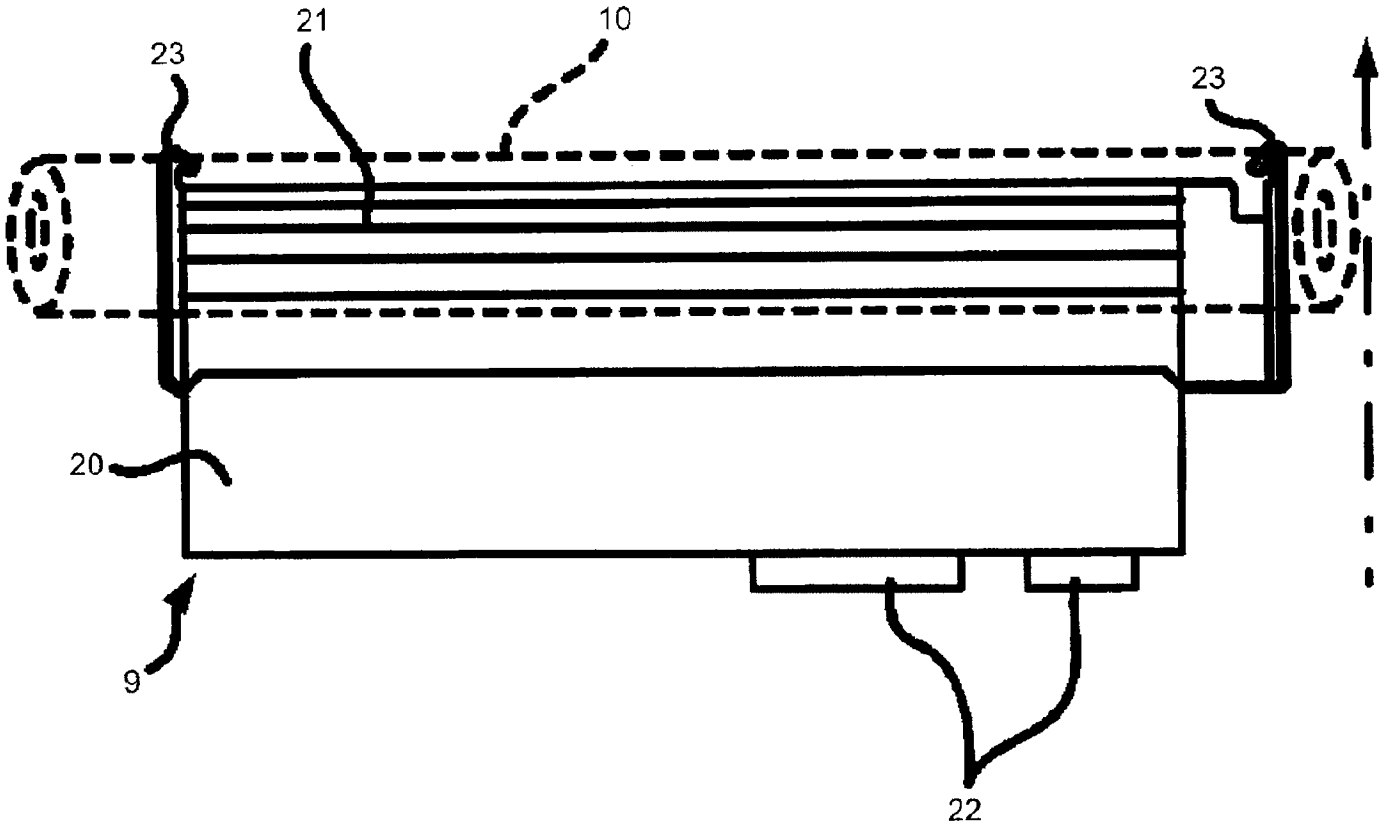
FIG.5 PRIOR ART
FIG. 5 is a rear view of the existing thermal head as viewed from a side of a platen roller.
Figure 6:
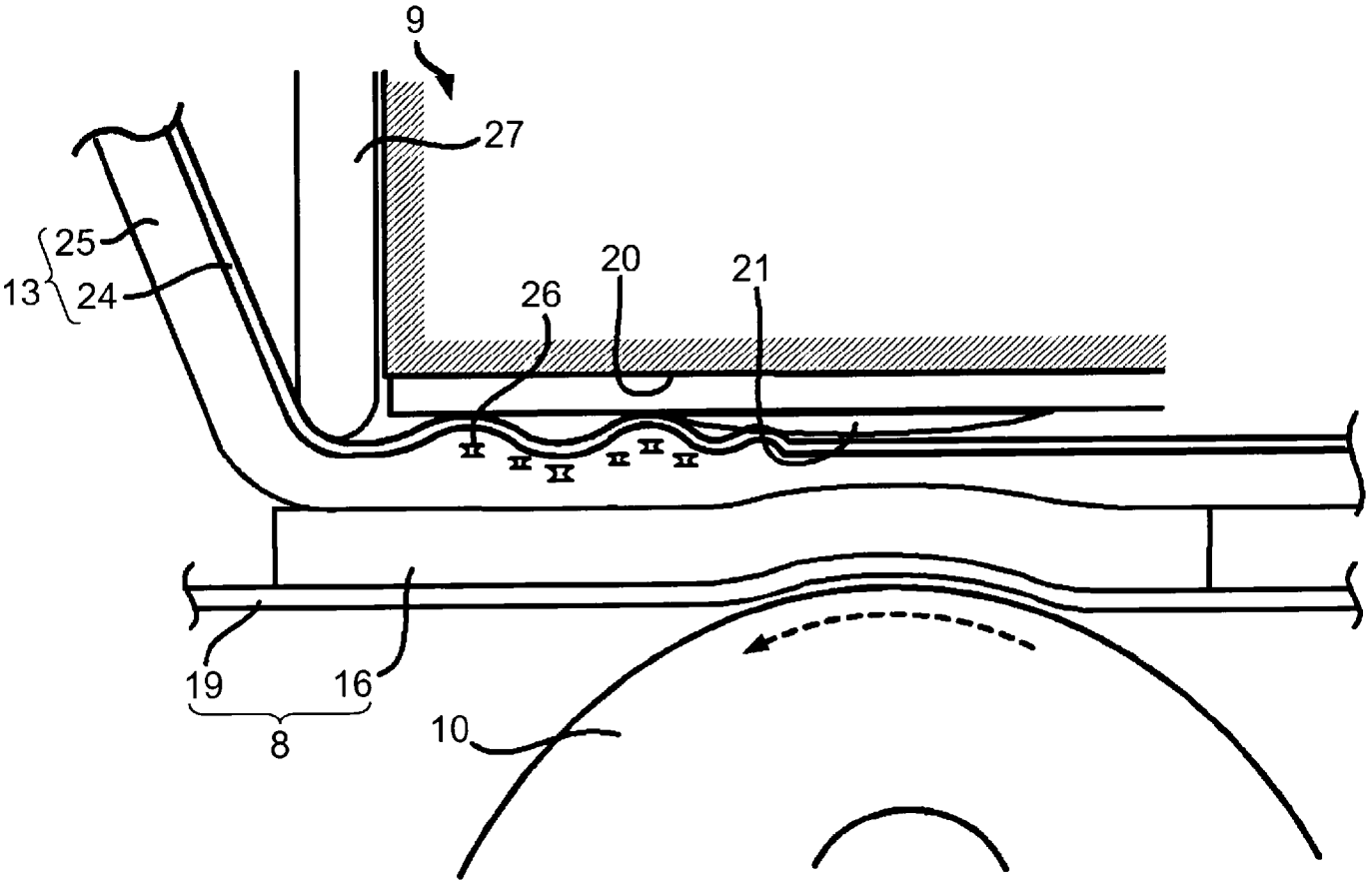
FIG. 6 is an enlarged side view of a printing unit of the thermal transfer printer in FIG. 4A, which includes the thermal head.

FIG. 3 is an enlarged sectional view of the printing unit 4 of the thermal transfer printer 28. The printing paper 8 is transported toward a downstream side in accordance with a rotary drive of the platen roller 10 in a direction illustrated by an arrow in the FIG. 3. When the printing paper 8 is sandwiched between the thermal head 29 and the platen roller 10, the ink ribbon 13 is heated by the heat generator 21, and the ink in the ink layer 25 is molten and adheres onto the printing paper 8. The ink is in a molten state immediately after the ink adheres onto the printing paper 8, but the ink is cooled when the ink ribbon 13 passes through the redirecting member 27. After the ink is transferred and fixed onto the printing paper 8, the ink ribbon 13 and the printing paper 8 are separated from each other. Although there is a possibility that the film layer 24 that is heated by the heat generator 21 warps in a wave-like shape if an amount of generated heat is high, as the ribbon transport direction changing member 30 pushes the ink ribbon 13 away from the heat generator 21, that is, as the transport direction of the ink ribbon 13 is slightly moved toward the platen roller 10, constant tension is given to the film layer 24 that is immediately after being heated.

Note that although the ribbon transport direction changing member 30 includes the projections 31 which are intermittently provided downstream from the heat generator 21 in the above-described embodiment, the projections 31 do not need to be provided intermittently. The ribbon transport direction changing member 30 may be provided continuously at a position parallel to the heat generator 21 as long as it falls within a range that can solve the problem of the present invention.

According to the above-described configuration, even if the ribbon transport direction changing member 30 pushes the ink ribbon 13 away from the heat generator 21, the printing operation can be carried out normally. Further, since the ink ribbon 13 and the printing paper 8 are pressed against the heat generator 21 by the platen roller 10, tension can be given to the ink ribbon 13 between the heat generator 21 and the redirecting member 27. Thus, even if the film layer 24 is warped due to heat, the friction force to be generated between a downstream portion of the heat generator 21 of the thermal head 29 and the film layer 24 can be reduced to a level at which a take-up speed of the ink ribbon 13 is not affected.

Further, since the ribbon transport direction changing member 30 is provided in the thermal head 29 in advance, a highly skilled operation for separating the ink ribbon 13 becomes unnecessary.

Further, forming the tip of the projection 31 in a curved shape reduces a surface thereof to come into contact with the ink ribbon 13, and thus the friction force to be generated between the thermal head 29 and the ink ribbon 13 can be reduced.

The invention claimed is:

1. A thermal head, comprising:

a head body;

a heat generator on the head body, wherein the thermal head allows a printing paper on an ink ribbon to be transported between the thermal head and a platen roller opposed to the thermal head and the heat generator allows necessary and possible printing information to be transferred onto the printing paper from the ink ribbon, the ink ribbon including a film layer; and a ribbon transport direction changing member which is provided parallel to the heat generator in a vicinity of the heat generator of the head body;

driving devices that move the printing paper and the ink ribbon over a straight path past the platen roller and then past the ribbon transport direction changing member; and wherein the ribbon transport direction changing member protrudes further toward the platen roller than the heat generator and urges the ink ribbon toward the platen roller to give constant tension to the film layer of the ink ribbon after it has been heated by the heat generator to stretch the ink ribbon.

2. The thermal head according to claim 1, wherein the ribbon transport direction changing member includes projections which are intermittently provided and separated.

3. The thermal head according to claim 1, wherein the ribbon transport direction changing member is provided downstream with respect to the heat generator along the ribbon transport direction.

4. The thermal head according to claim 2, wherein the projections comprise intermittently applied non-volatile resin bulge portions having respective ribbon contact tips to which the resins are applied.

5. The thermal head according to claim 1, wherein the ribbon transport direction changing member includes projections which are intermittently provided and separated;

the projections comprise intermittently applied non-volatile resin bulge portions having respective ribbon contact tips; and the projections are formed so that tips of the projections are circular-arc-shaped.

6. A thermal transfer printer comprising:

a thermal head;

a platen roller which is arranged to oppose to the thermal head;

the thermal transfer printer is configured to perform a printing operation with a printing paper and an ink ribbon which transfers ink from the ribbon to print on the printing paper by sandwiching the paper and the ink ribbon between the thermal head and the platen roller, the ink ribbon including a film layer; and the thermal head includes a heat generator in a widthwise direction of the printing paper;

the thermal head includes a ribbon transport direction changing member downstream from the heat generator along the ribbon transport direction, and a tip of the ribbon transport direction changing member protrudes toward the platen roller to a position to make contact with the ink ribbon, wherein the ribbon transport direction changing member protrudes further toward the platen roller than the heat generator and urges the ink ribbon toward the platen roller to give constant tension to the film layer of the ink ribbon after it has been heated by the heat generator to stretch the ink ribbon.

7. The thermal transfer printer according to claim 6, further including a plurality of heating elements aligned in the widthwise direction of the printing paper.

8. The thermal printer according to claim 6, wherein the ribbon transport direction changing member includes projections which are intermittently provided and separated.

9. The thermal printer of claim 6, further comprising driving devices that move the printing paper and the ink ribbon over a straight path past the platen roller and then past the ribbon transport direction changing member; and wherein the ribbon transport direction changing member protrudes further toward the platen roller than the heat generator for moving the ink ribbon off the heat generator.

10. The thermal head according to claim 1, further including a plurality of heating elements aligned in the widthwise direction of the printing paper.

* * * * *